US005390601A

United States Patent [19]

Fricke et al.

[11] Patent Number: 5,390,601

[45] Date of Patent: Feb. 21, 1995

[54] GRIPPER CONTROL FOR SHEET GRIPPERS ON A SHEET-GUIDING CYLINDER OR THE LIKE IN A PRINTING PRESS

[75] Inventors: Andreas Fricke, Eberbach; Norbert Thünker, Hirschberg, both of Germany

[73] Assignee: Heidelberger Druckmaschinen AG, Heidelberg, Germany

[21] Appl. No.: 88,423

[22] Filed: Jul. 6, 1993

[30] Foreign Application Priority Data

Jul. 3, 1992 [DE] Germany ..... 4221929

[51] Int. Cl.[6] ..... B41F 21/10

[52] U.S. Cl. ..... 101/409; 101/410; 271/277

[58] Field of Search ..... 101/408, 409, 410, 411, 101/412, 415.1, 181, 248; 271/82, 204, 277

[56] References Cited

U.S. PATENT DOCUMENTS

| | | | |
|---|---|---|---|
| 4,003,310 | 1/1977 | Decker, II | 101/411 |
| 4,127,265 | 11/1978 | Wirz et al. | 101/409 X |
| 4,375,190 | 3/1983 | Quinci et al. | 101/177 |
| 4,458,893 | 7/1984 | Ruh | 101/277 |
| 5,184,554 | 2/1993 | Merkel et al. | 101/415.1 |
| 5,186,105 | 2/1993 | Emrich et al. | 101/248 X |

FOREIGN PATENT DOCUMENTS

| | | |
|---|---|---|
| 83166 | 7/1971 | German Dem. Rep. . |
| 96053 | 3/1973 | German Dem. Rep. . |
| 1100043 | 2/1961 | Germany . |
| 2113750 | 10/1971 | Germany . |
| 2302519 | 8/1973 | Germany . |
| 3622310 | 2/1987 | Germany . |
| 3519293 | 4/1989 | Germany . |
| 4013106 | 12/1991 | Germany . |
| 4034323 | 4/1992 | Germany . |

OTHER PUBLICATIONS

Japanese Patent Abstract JP 59073951 (Ishida Masaaki) Apr. 26, 1984.

*Primary Examiner*—Edgar S. Burr
*Assistant Examiner*—Christopher A. Bennett
*Attorney, Agent, or Firm*—Herbert L. Lerner; Laurence A. Greenberg

[57] ABSTRACT

Gripper control for sheet grippers on a sheet-guiding cylinder or the like in a printing press, wherein a stationary pressure generator for a pressure medium is connected by means of a coupling, through the intermediary of a motor-actuated servo-valve, to a sheet-gripper actuating system disposed on the cylinder or the like and, through a control system, being acted upon by the pressure medium in time with an operating cycle of the printing press, includes a piston-cylinder unit forming part of the actuating system, a displacement-measuring system connected to the piston-cylinder unit, respective elements for pivotally connecting the piston-cylinder unit, at one end thereof, to the sheet-guiding cylinder or the like and, at the other end thereof, to a lever connected to the sheet gripper, the control system including a programmable control computer connected by measuring lines to the displacement-measuring system and, via a position-control loop, being capable of controlling a motor-actuated positioning of the servo-valve as a function of relative positions of piston and cylinder of the piston-cylinder unit, taking into account the printing-press speed and forces generated by moving masses.

6 Claims, 2 Drawing Sheets

GRIPPER CONTROL FOR SHEET GRIPPERS ON A SHEET-GUIDING CYLINDER OR THE LIKE IN A PRINTING PRESS

BACKGROUND OF THE INVENTION

1. Field of the Invention

The invention relates to a gripper control for sheet grippers on a sheet-guiding cylinder or the like in a printing press, wherein a stationary pressure generator for a pressure medium is connected by means of a coupling, through the intermediary of a servo-valve actuatable by a motor, to a sheet-gripper actuating system disposed on the cylinder or the like and being acted upon by the pressure medium through a control system, in time with an operating cycle of the printing press.

2. Description of the Related Art

Such a gripper control has become known heretofore from German Published Non-Prosecuted Patent Application (DE-OS) 23 02 519. A pressure generator, not otherwise described in any greater detail in this publication, is connected via a servo-valve, which is adjusted by means of a driven cam plate, through the intermediary of a tube coupling in the form of a rotary connector, to a sheet-gripper actuating system disposed on the cylinder and formed of a diaphragm member acted upon by the pressure medium, and of a spring element.

Compared with all-mechanical gripper controls, such a gripper control reduces the moving masses and therefore also the reaction of controlling and inertial forces on the main drive of the printing press. The cam plate permits the rotational speed-dependent time response of the gripper control to be controlled only to an inadequate extent, unless every conceivable printing-press speed were to be associated with its own cam plate. An adjustable cam plate according to claim 3 of the aforementioned publication would have to have a correspondingly costly, rotational speed-dependent control, the outlay for which does not, however, justify any resultant benefits derivable therefrom.

Heretofore known from German Patent 21 13 750 is a magnetically actuatable sheet gripper wherein a gripper finger is moved into a closed position by an electromagnet against the force of a spring. Reliable operation for in-register sheet gripping and transfer within a wide rotational-speed range is not achievable due to rotational speed-dependent switching delays, which have an effect upon the closing of the gripper.

It has also become known heretofore from German Published Prosecuted Patent Application (DE-AS) 11 00 043 to connect a gripper finger of a relatively simple gripper system to an hydraulically or pneumatically operated piston-cylinder unit and to actuate the latter by means of a valve controlled by a cam. Accurate sheet gripping is not provided for with this heretofore known arrangement.

It is accordingly an object of the invention to provide an improvement in the gripper control of the type initially described in the introduction hereto and to further improve the action thereof through the use of electronic control features.

SUMMARY OF THE INVENTION

With the foregoing and other objects in view, there is provided, in accordance with the invention, a gripper control for sheet grippers on a sheet-guiding cylinder or the like in a printing press, wherein a stationary pressure generator for a pressure medium is connected by means of a coupling, through the intermediary of a motor-actuated servo-valve, to a sheet-gripper actuating system disposed on the cylinder or the like and, through a control system, being acted upon by the pressure medium in time with an operating cycle of the printing press, comprising a piston-cylinder unit forming part of the actuating system, a displacement-measuring system connected to the piston-cylinder unit, respective means for pivotally connecting the piston-cylinder unit, at one end thereof, to the sheet-guiding cylinder or the like and, at the other end thereof, to a lever connected to the sheet gripper, the control system comprising a programmable control computer connected by measuring lines to the displacement-measuring system and, via a position-control loop, being capable of controlling a motor-actuated positioning of the servo-valve as a function of relative positions of piston and cylinder of the piston-cylinder unit, taking into account the printing-press speed and forces generated by moving masses.

In contrast with conventional gripper-control constructions of this general type, the gripper control of the invention offers the advantage that the movement of the gripper can be controlled more flexibly. The computer control permits more precise consideration of and, above all, more rapid adaptation to changes in operating conditions. The gripper force is controllable by a program preselection or input and is thus optimally adjustable in accordance with the stock to be printed. The printing press is subjected only to the moment or torque resulting from the inertia of the gripper finger, the gripper shaft and the piston in the actuating system. Reactions of gripper bounce or recoil on the journals of the cylinder in the printing press and thus on the printing-press frame are avoided, as a result of which vibrations in the printing press are reduced. Consequently, the features according to the invention make a considerable contribution towards smoother operation of the printing press and towards a reduction in undesired noise formation.

In accordance with another feature of the invention, the gripper control includes an angle-measuring system electrically connected to the control computer, the angle-measuring system being disposed on one of a main shaft of the printing press and a shaft of the sheet-guiding cylinder.

In accordance with a further feature of the invention, the gripper control includes a power regulator for the motor-actuated positioning drive of the servo-valve connected electrically to the control computer, the power regulator being integrated into the position-control loop of the gripper control.

In accordance with a concomitant feature of the invention, the pressure generator is disposed in a frame of the printing press.

Other features which are considered as characteristic for the invention are set forth in the appended claims.

Although the invention is illustrated and described herein as embodied in a gripper control for sheet grippers on a sheet-guiding cylinder or the like in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which:

DESCRIPTION OF THE PREFERRED EMBODIMENTS

Figure 1:
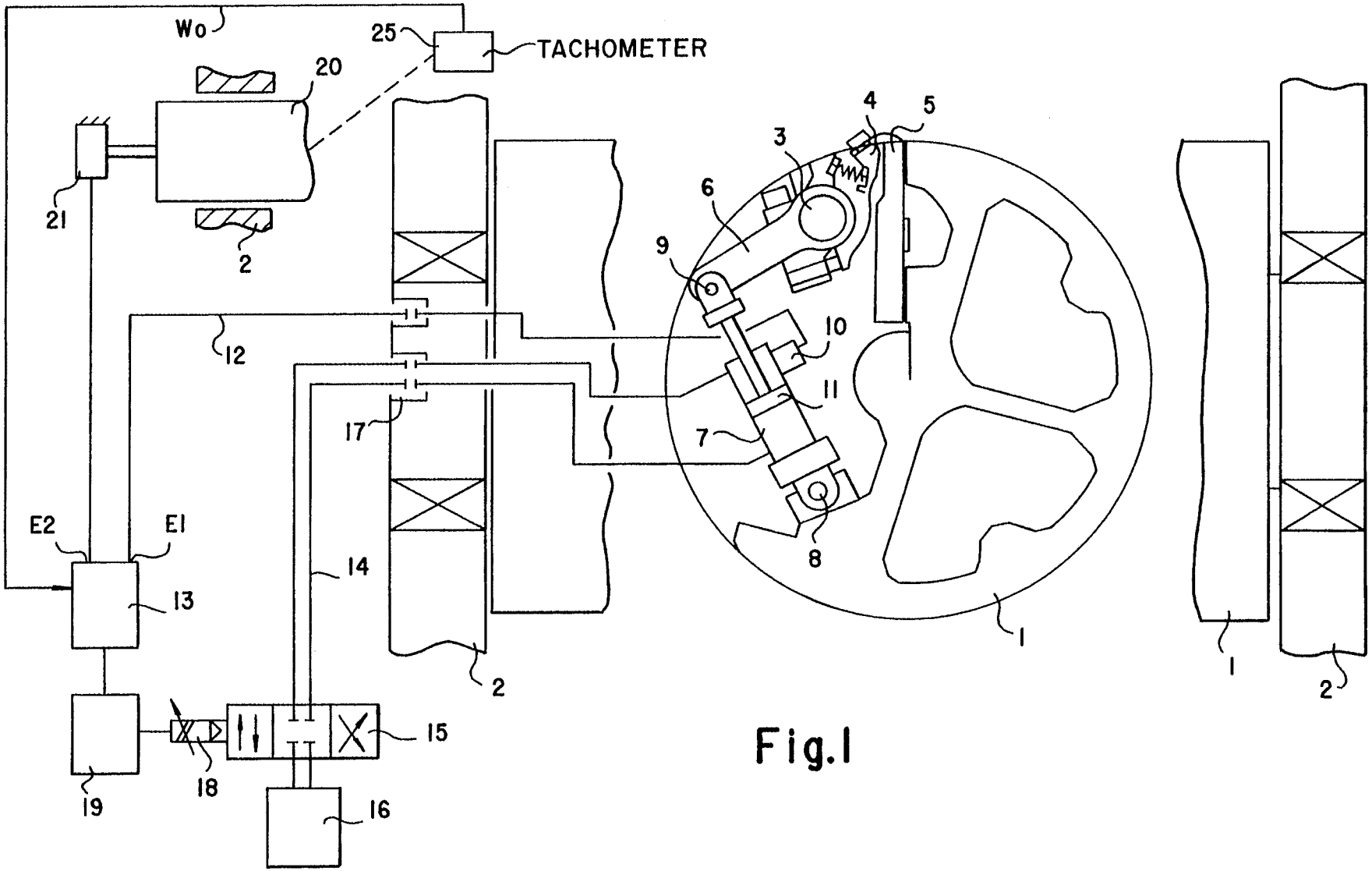
FIG. 1 is a diagrammatic and schematic view of the gripper control for sheet grippers on a sheet-guiding cylinder in a printing machine.

Referring now to FIG. 1 of the drawing, there is shown therein a sheet-guiding cylinder 1 rotatably journalled in a frame 2 of the printing press. The gripper shaft 3 is supported on the cylinder 1 in an axially extending channel or gap formed in the cylinder 1. Mounted on the gripper shaft 3 is a sheet gripper 4 or, juxtaposed at axial intervals thereon, a plurality of sheet grippers 4, which cooperate in a conventional manner with a gripper pad 5 on the cylinder 1. To deflect the gripper shaft 3 for effecting a gripper movement, a lever 6 is fastened to the gripper shaft 3. An actuating system is formed of a piston-cylinder unit 7, which has a cylinder housing pivotally connected to the cylinder 1 at a location 8, and a piston rod articulatingly connected at a location 9 to a free end of the lever 6. The piston-cylinder unit 7 is provided with a displacement-measuring system 10 for detecting the position of a piston 11 in the piston-cylinder unit 7. The piston-cylinder unit 7 may be disposed inside the cylinder 1 or, alternatively, at an end face of the cylinder 1. The displacement-measuring system 10 is connected, through the intermediary of measuring lines 12 extending out of the cylinder 1 at an end face thereof, to an input El of a control computer 13. Connecting lines 14 for a pressure medium connect both cylinder chambers, respectively, forward of and behind the piston 11 of the piston-cylinder unit 7 in the cylinder 1, to a pressure generator 16 through the intermediary of a servo-valve 15. The lines 14, also, extend out of the cylinder 1 at an end face thereof and have a tube coupling 17 in the form of a rotary connector of the same type provided also, in simplified form, as a current-lead coupling for the measuring line 12. A motor-actuated positioning drive 18 of the servo-valve 15 is controlled by a regulator 19, which is connected electrically to the computer 13 and which acts as a power controller for the positioning drive 18. In order to synchronize the gripper control with the position of the printing press, a main shaft 20 of the printing press, preferably the shaft of the cylinder 1, is provided with an angle-measuring system 21, which supplies a signal proportional to the position of the main shaft to the control computer 13 via an input E2. The control computer 13, the regulator 19, the servo-valve 15, the piston-cylinder unit 7 of the actuating system and of the displacement-measuring system 10 form a position-control loop for implementation of the gripper movement. The angle-measuring system 21 activates an associated value from a sequence of position setpoint values of the oscillating movement of the piston 11. The relative standstills of the gripper 4 with respect to the cylinder 1 in the open and closed states are included in the sequence of setpoints. The position setpoint values can be computed as a function of rotational speed or can be taken from a stored table for the respective rotational-speed range. The control computer 13 compares the position of the piston 11, as supplied by the displacement-measuring system 10 on the piston-cylinder unit 7, with the activated position setpoint value,. In accordance with the difference therebetween, a signal for control of the pressure medium is sent via the regulator 19, which acts as the power controller, to the positioning drive 18 of the servo-valve 15, as a result of which the piston 11 and thus the gripper 4 are appropriately moved. Each further signal from the angle-measuring system 21 initiates a retrieval of the following position setpoint value. After the sequence of setpoint values has been executed, the process is restarted with the first value.

Figure 2:
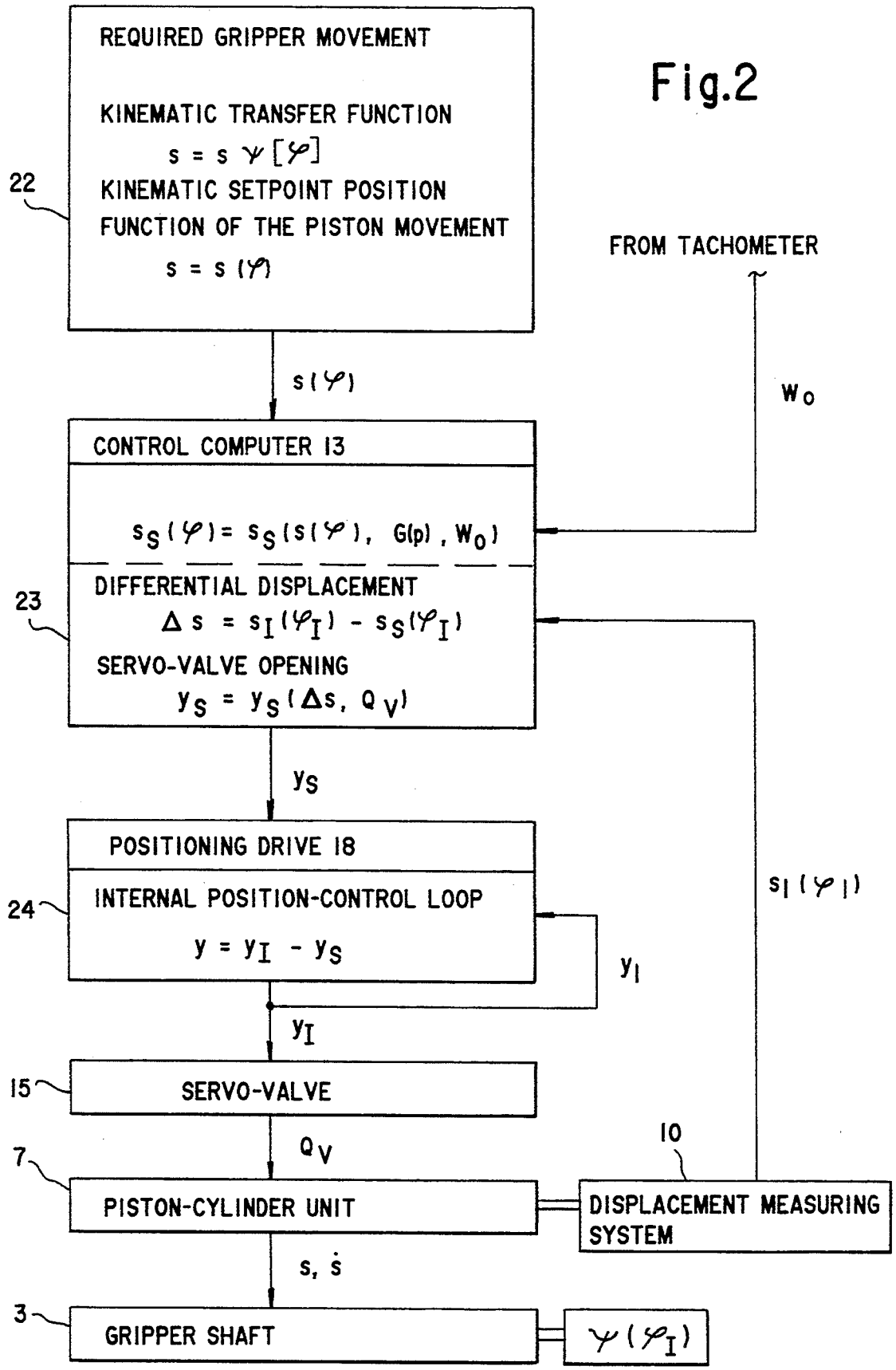
FIG. 2 is a combined block diagram and flow chart showing the operation of the position-control loop according to the invention.

The angle-measuring system 21, the control computer 13, the regulator or power controller 19 and the pressure generator 16 are generally conventional, commercially available devices serving as components, for example, of hydraulic or pneumatic drives for position-control loops or circuits. In the combined block diagram and flow chart of FIG. 2, the operation of the position control loop of the invention is illustrated as follows:

At 22, the gripper movement $\Psi(\phi)$ to be produced, of which $\phi$ is the press angle measured at the cylinder 1 or at the main shaft 20, respectively, can be obtained by a corresponding extension distance $s(\phi)$ of the piston 11 with respect to the cylinder 7. The kinematic nominal or set-point movement $s(\phi)$ is fed beforehand as a point sequence and as a function, respectively, at 23, to the control computer 13 for a rotation of the cylinder 1 and the main shaft 20, respectively. Because the position-control loop of the herein aforedescribed system has a time-delayed behavior, the kinematic nominal movement $s(\phi)$ must be adjusted in accordance with the angular velocity $\omega_o$ of the cylinder 1 and the main shaft 20, respectively, which can be assumed to be constant when considered over many rotations. Taking into account the transfer function G(p) for automatic control technology, the control computer 13 determines the nominal or setpoint position value $s_S(\phi)$ of the piston 11, which it stores point-for-point for $\phi=0 \ldots 360$ degrees of press angle. The control computer 13 receives the actual angular velocity value $\omega_o$ from a tachometer of the printing press.

To convert the piston movement, the control computer 13 receives the information regarding the actual rotary angle $\phi_I$ of the cylinder 1 or of the main shaft 20, respectively. It associates this angle with the corresponding setpoint position value $s_S(\phi_I)$ of the piston 11. This setpoint value is compared by the control computer with the actual position value $s_I(\phi_I)$ determined by the displacement-measuring system 10, from which the differential displacement $\Delta s = s_I - s_S$ results. A volume flow $Q_V$, which is achieved by a defined setpoint opening $y_S$ of the servo-valve 15, is required for performing the differential displacement $\Delta S$ within a given time unit. The opening and closing of the servo-valve 15 is effected, at 24, via an internal position control loop of the positioning drive 18 for regulating the opening y.

A regulating or control cycle is terminated when the setpoint opening $y_S$ has been obtained. The resulting actual position value $s_I(\phi_I)$ of the piston 11 is detected by the displacement-measuring system 10 and communicated to the control computer. A further cycle for obtaining the setpoint position value $s_S(\phi_I)$ then follows.

When the angle-measuring system 21 signals the next angle step, i.e., the press angle $\phi_{I+1}$ has been obtained, the setpoint position value $s_S(\Psi_{I+1})$ is activated by the control computer. The entire control process is repeated. After one rotation of the cylinder 1 and the main shaft 20, respectively, has been completed, the run-through of the setpoint position-value sequence is repeated.

If the angular velocity $\omega_o$ of the cylinder 1 and the main shaft 20, respectively, has varied over a given tolerance $\Delta\omega_o$, the setpoint value sequence $s_S(\phi)$ of the piston movement, because of the varying time relationship of the position control loop, must then be newly computed by the control computer 13, stored and run-through or processed again.

We claim:

1. A gripper control for sheet grippers of a printing press comprising:

a sheet guiding cylinder having at least one sheet gripper mounted thereon;

a piston-cylinder unit in operative engagement with said gripper for opening and closing the gripper;

a servo-valve fluidly communicating with said piston-cylinder unit, having a pressure generator connected to an input of said servo-valve;

a control computer having a control output in operative engagement with said servo-valve for controlling opening and closing of the valve, said computer having at least one control input; and an angle measuring system having an input connected to said printing press, and an output connected to said control computer for actuating said gripper through the intermediary of said servo-valve, and said piston-cylinder unit at position setpoint values of positions of said piston-cylinder unit.

2. Gripper control according to claim 1, wherein said angle-measuring system is electrically connected to said control computer, said angle-measuring system being disposed on one of a main shaft of the printing press and a shaft of the sheet-guiding cylinder.

3. Gripper control according to claim 1, including a power control regulator having an input connected to said control computer, a motor-actuated positioning drive having an input connected to an output of said power control regulator, and an output controlling said servo-valve, a position-control loop connected from an output of said control computer and an input to said servo-valve, and wherein said power regulator is integrated into said position-control loop.

4. Gripper control according to claim 1, wherein the pressure generator is disposed in a frame of the printing press.

5. A gripper control according to claim 1, wherein said piston-cylinder unit is disposed in said sheet guiding cylinder, said cylinder unit having two pressure inputs, and a tube coupling in said sheet guiding cylinder fluidly coupling said pressure inputs to said servo-valve.

6. A gripper control according to claim 1, including a displacement measuring system connected to said piston-cylinder unit for measuring displacement of said piston in said cylinder, said displacement measuring system having an output connected to a further input of said control computer.

* * * * *